US005863384A

United States Patent [19]

Reddy

[11] Patent Number: 5,863,384

[45] Date of Patent: Jan. 26, 1999

[54] SELF ADHESIVE POSTAGE STAMP DISPENSER AND APPLICATOR

[76] Inventor: Surender D Reddy, P.O. Box 319, Crownsville, Md. 21032-0319

[21] Appl. No.: 931,040

[22] Filed: Sep. 16, 1997

[51] Int. Cl.[6] ..... B44C 1/10

[52] U.S. Cl. ..... 156/576; 156/577

[58] Field of Search ..... 156/574, 576, 156/577

[56] References Cited

U.S. PATENT DOCUMENTS

| | | | |
|---|---|---|---|
| 3,969,181 | 7/1976 | Seabold | 156/577 |
| 4,288,276 | 9/1981 | Schrotz et al. | 156/577 X |
| 4,954,208 | 9/1990 | Hamisch, Jr. et al. | 156/577 |
| 5,393,368 | 2/1995 | Stevens | 156/574 X |
| 5,641,377 | 6/1997 | Chung et al. | 156/577 |

FOREIGN PATENT DOCUMENTS

| | | | |
|---|---|---|---|
| 1129416 | 5/1962 | Germany | 156/577 |

*Primary Examiner*—Mark A. Osele

[57] ABSTRACT

This invention discloses a compact dispenser and applicator of stamps from self adhesive postage stamp rolls that is particularly well suited for typical postage stamp users. The dispenser comprises a mechanism assembly that slides into a compact housing assembly attached with an applicator roller. The mechanism assembly comprises a stamp roll holding chamber, s stamp conveyer platen with a separator edge at its end for separating stamps from the backing paper, a backing paper spooler with a connector strap to attach to the free end of the backing paper and a ratchet wheel for rotating the spooler. When the ratchet wheel is rotated with a finger, the ratchet wheel causes the spooler to rotate and to spool the backing paper, thereby causing the backing paper to retract over the stamp conveyer platen and the separator edge. The retracting backing paper experiences an abrupt change of direction, thereby causing the stamp to separate from the backing paper. The applicator roller attached to the housing assembly is used for deploying the stamp after moving the dispenser to appropriate location on the mail.

2 Claims, 9 Drawing Sheets

SELF ADHESIVE POSTAGE STAMP DISPENSER AND APPLICATOR

BACKGROUND OF THE INVENTION

1. Field of the Invention

The present invention relates generally to postage stamp dispensers and particularly to portable dispensers of postage stamps that are available in the form a roll. More particularly, the present invention relates to portable dispensers of postage stamps that are available in the form of rolls of self adhesive pressure sensitive stamps.

2. Description of the Prior Art

Postage stamps of common denomination, such as a postage stamp necessary to send an ordinary letter by first class mail, are available, for convenience of storage and usage, in the form of rolls, each roll contains a large number of stamps. These postage stamp rolls are available in two types. One type has stamps with pre-glued back side requiring moistening prior to placement on the mail. The other and the more recently introduced type has stamps with self adhesive backside requiring separation from the backing paper prior to placement on the mail.

A variety of dispensers and applicators for use with the postage stamp rolls with the pre-glued backside are described in the prior art. The prior art dispensers and applicators that adequately perform are generally bulky, making them inappropriate for a typical postage stamp user and suitable only for large offices and mass mailing situations. The prior art dispensers that are appropriate for typical postage stamp users commonly comprise a small container with a slot which permit the stamps to be manually pulled out through the slot torn out, moistened and affixed to the mail. Although these prior art small dispensers were developed before the self adhesive postage stamp rolls became available, these dispensers can be used with such rolls. Use of these dispensers with self adhesive type postage stamp rolls involves manually drawing through the slot a post stamp with the backing paper attached, manually separating the stamp from the backing paper using a finger nail or some other sharp object, tearing the stamp from the rest of the roll, attaching the stamp to the mail, tearing the backing paper from the unused portion of the roll and disposing the torn backing paper in the trash. Hence, use of these prior art small dispensers with self adhesive postage stamp rolls is at least as tedious as using them with the pre-glued postage stamp rolls.

The object of the present invention is a compact and inexpensive dispenser and applicator of stamps from self adhesive postage stamp rolls that is particularly well suited for typical postage stamp users. The present invention provides a novel postage stamp dispenser and applicator specifically designed to retain a self adhesive postage stamp roll to dispense a postage stamp and separate it from the backing paper and the postage stamp roll, to apply the stamp to the mail, and to spool the backing paper in the stamp dispenser for disposal after the stamp roll is completely used up. The device of the present invention provides a means for retaining a roll of self adhesive postage stamps, associated therewith, a means for automatically dispensing the remaining stamps in series from this retaining means while simultaneously separating and spooling the backing paper inside the device. The device also includes a means for applying pressure to adhere the stamp separated from the backing paper to the mail while concurrently separating the stamp from the stamps still remaining in the dispenser.

DESCRIPTION OF THE PREFERRED EMBODIMENT

Figure 1:
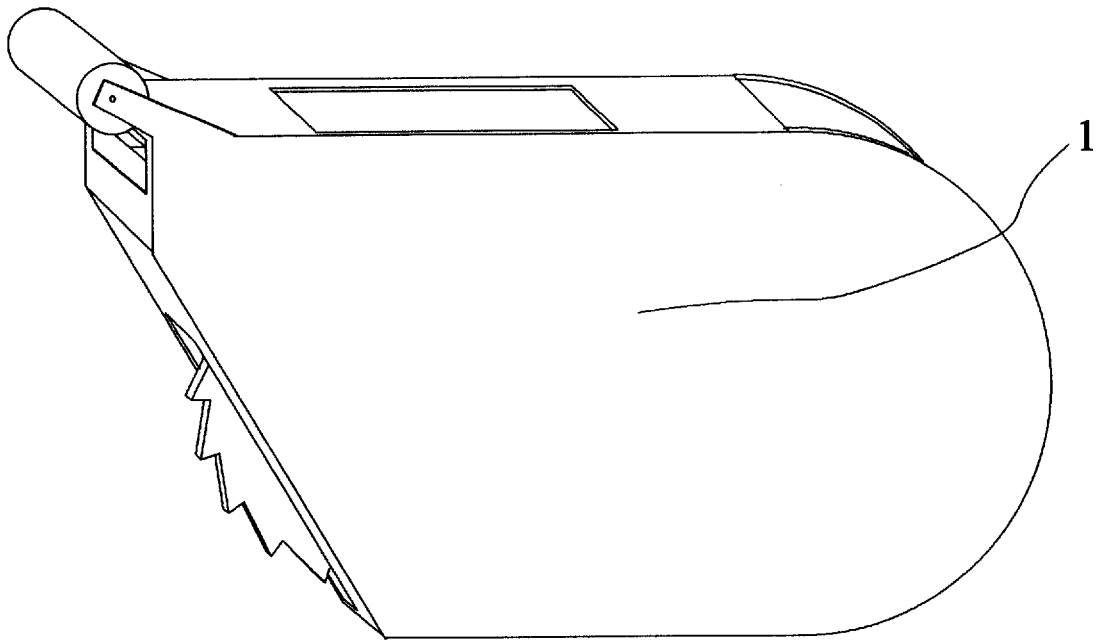
FIG. 1 shows a completely assembled perspective view of a self adhesive postage stamp dispenser and applicator in accordance with the present invention.
Figure 2:
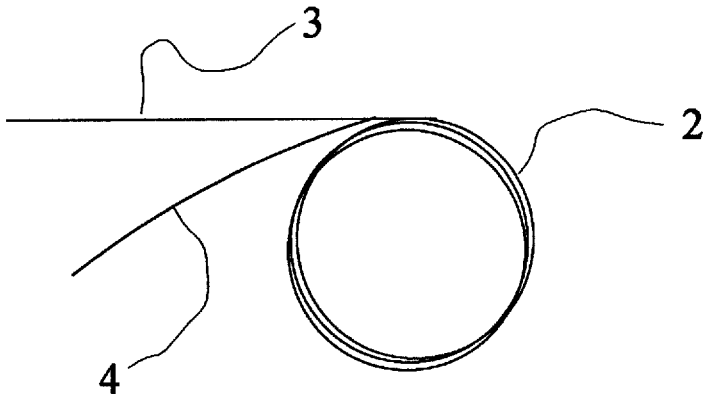
FIG. 2 shows a self adhesive postage stamp roll.
Figure 3:
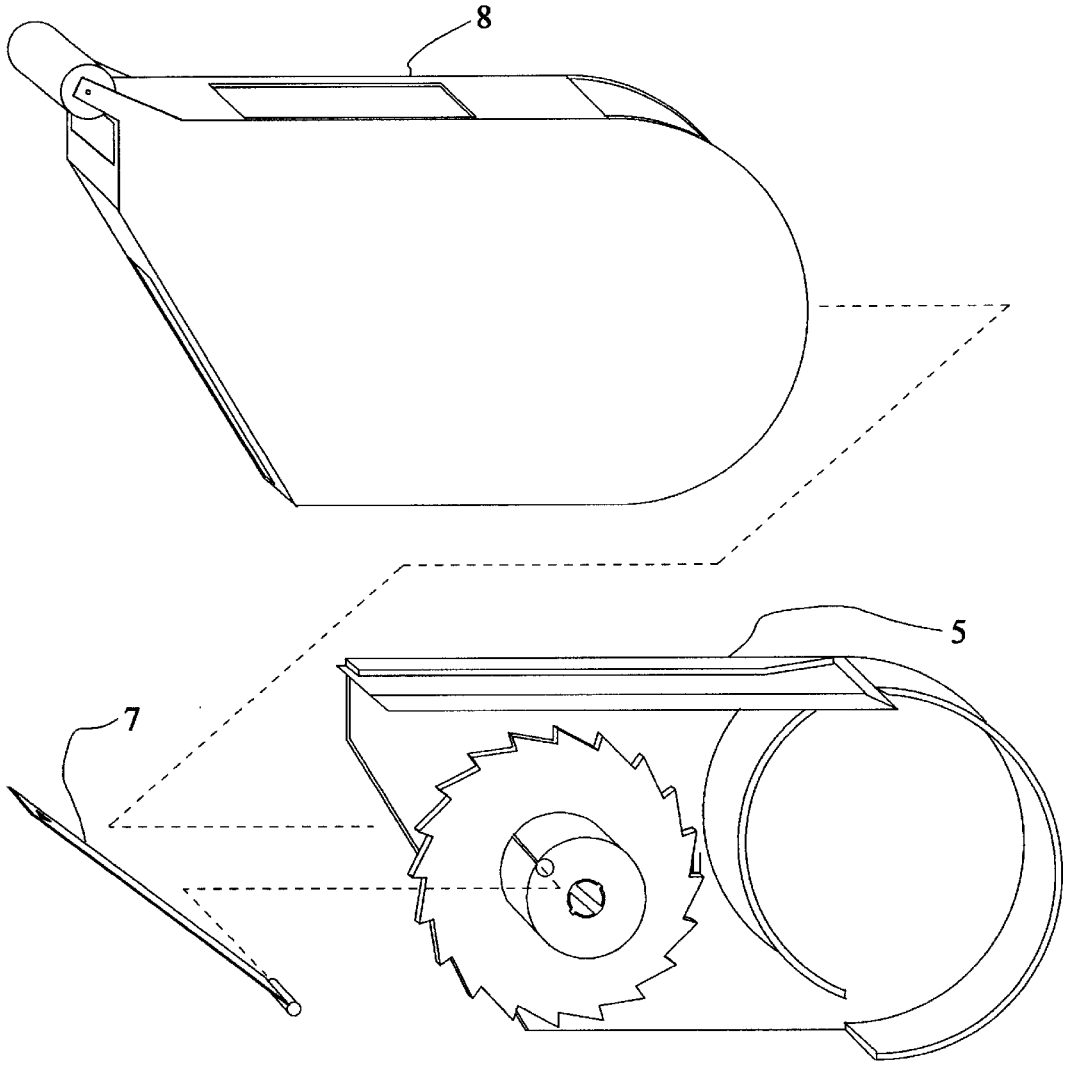
FIG. 3 shows the device shown in FIG. 1. disassembled into its major subassemblies.

The diagrams show a dispenser and applicator 1, hereafter called the "device", for a roll of self adhesive postage stamps 2, hereafter call the "stamp roll". Stamp roll comprises a non-permanent-stick backing paper 4 attached to the back of a ribbon of stamps 3 in which a series of perforation are provided for separating each stamp from the remaining ribbon of stamps. Device 1 as shown disassembled in FIG. 3 comprises a mechanism subassembly 5, a connector strap 7 and a housing subassembly 8.

Figure 4:
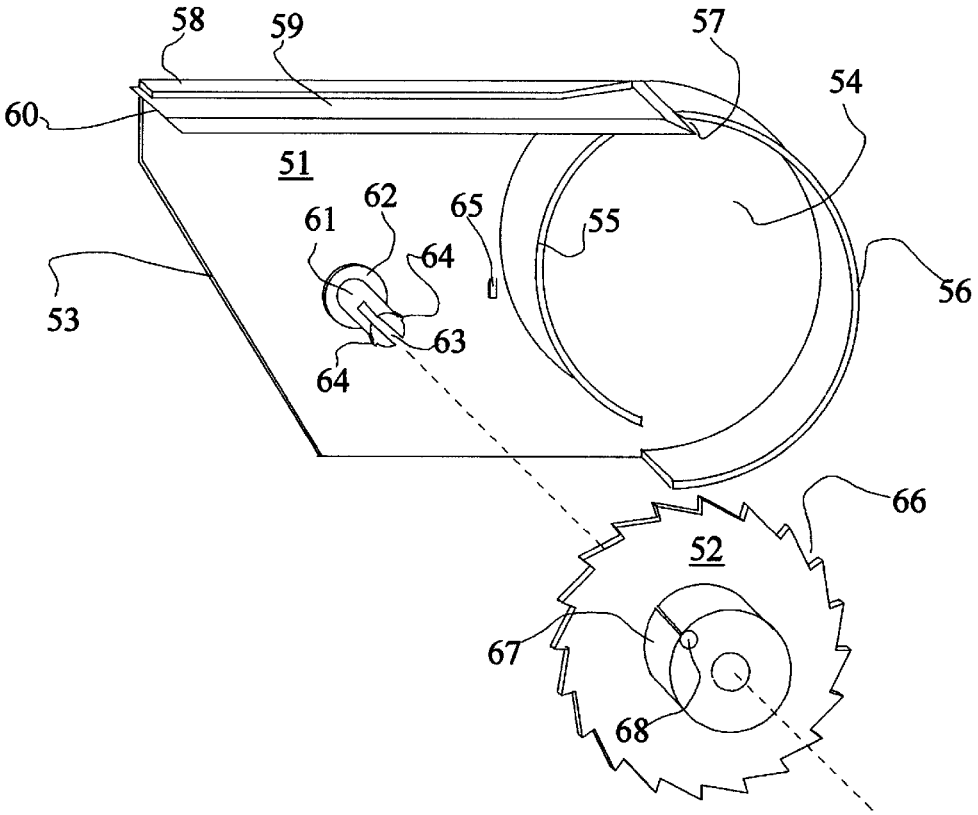
FIG. 4 shows a disassembled view of the mechanism subassembly.
Figure 5:
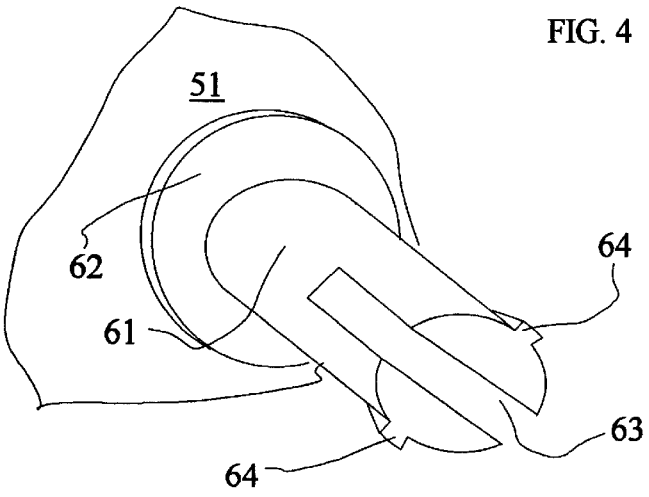
FIG. 5 shows an enlarged view of the spindle.
Figure 6:
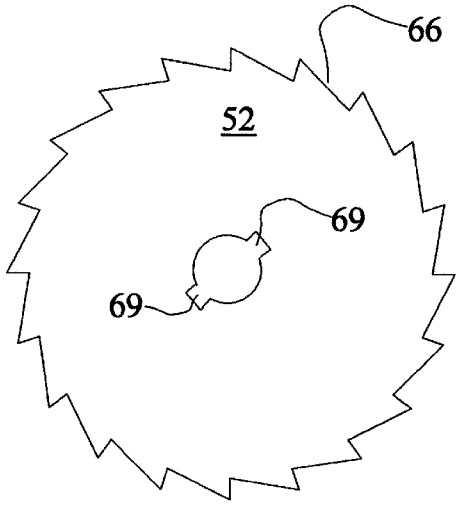
FIG. 6 shows an enlarged view of the bottom side of the ratchet wheel and reel.

Mechanism subassembly 5 as shown disassembled in FIG. 4 comprises a frame 51 and an integrated ratchet wheel and reel 52. Frame 51 comprises:

- a base 53;
- a stamp roll holding chamber 54 in the right part of frame 51 formed by two nearly semi-circular walls 55 and 56 attached to base 53;
- a slot 57 formed by the upper edges of the two semi-circular walls 55 and 56;
- a stamp conveyer guide 58 formed by a wall attached to the top edge of base 53, and with a thickness slightly exceeding the combined thickness of stamp 3 and backing paper 4;
- a stamp conveyer platen 59 formed by a wall attached to base 53 and the underside of guide 58;
- an acutely angled separator edge 60 at the left end of stamp conveyer platen 59 and slightly protruding over the left edge of base 53;

a spindle 61 with a spacing platform 62 around its bottom extreme and a slot 63 and protrusions 64 at its top extreme for holding the integrated wheel and reel 9 in place, as shown in FIG. 5, attached to the base 53 in the left part of the frame 51;

a detent 65 molded out of the base 53 with its bottom end normally positioned free and raised above base 53 and with its top end attached flush to base 53 at a distance from the center of spindle 61 which is slightly less than the radius of integrated ratchet wheel and reel 52;

Integrated ratchet wheel and reel 52 comprises a ratchet wheel 66 and a reel 67 with a connector slot 68 for attaching connector strap 7. As shown in FIG. 6, the shaft of integrated ratchet wheel and reel 52 has tapered indents 69 on its bottom side. Ratchet wheel and reel 52 is assembled to 51 frame by sliding it on to spindle 61 while aligning indents 69 in the shaft on the underside of ratchet wheel and reel 52 with protrusions 64 in spindle 61. Detent 65 in base 53 of frame 51 restricts ratchet wheel 66 to be rotated only in an anti-clock direction.

Figure 7:
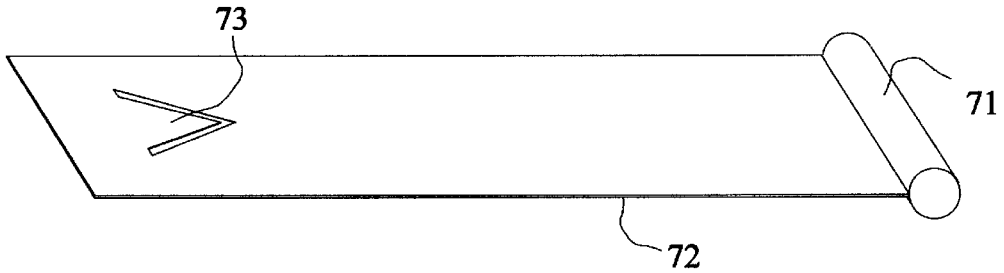
FIG. 7 shows an enlarged view of the connector strap.

Connector strap 7, as shown in FIG. 7, comprises a thin cylinder 71 attached to one end of flexible flat part 72 which is approximately three inches long. A "v" shaped cutout in flat part 72 near the other end of connector strap 7 forms a hook 73 for attaching strap 7 to backing paper 4 of stamp roll 2. Connector strap 7 is attached to ratchet wheel and reel 52 by inserting cylindrical end 71 of connector strap 7 into slot 68 of ratchet wheel and reel 52.

Figure 8:
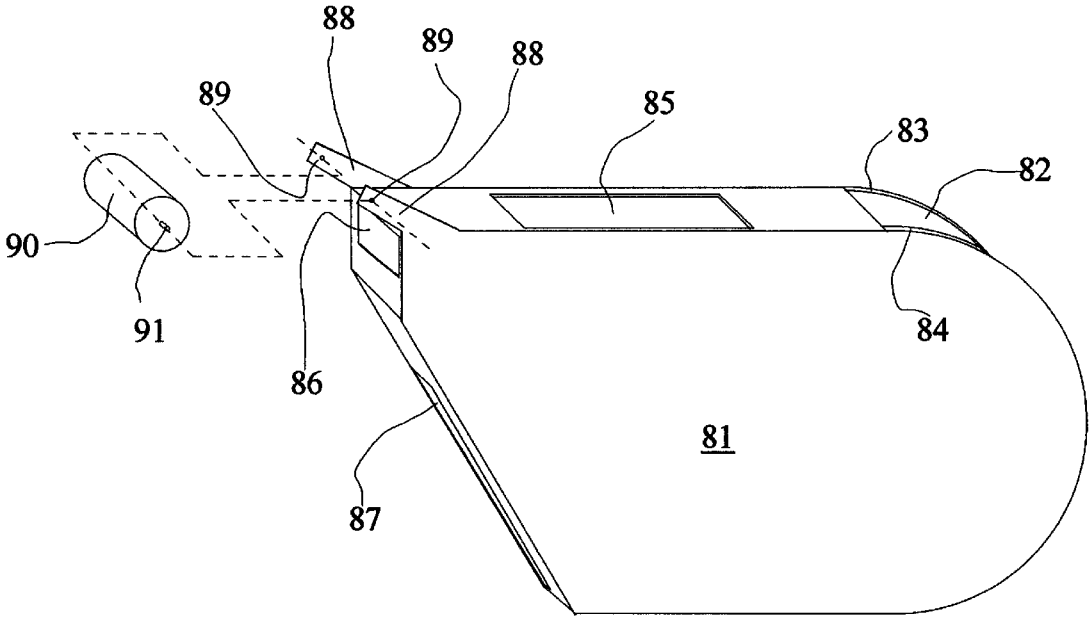
FIG. 8 shows a disassembled view of the housing subassembly.
Figure 19:
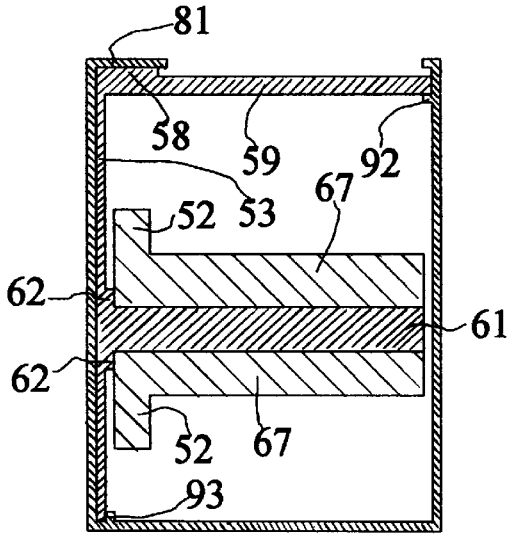
FIG. 19 is a cross-sectional view taken along section lines line 19—19 in FIG. 13 without the connector strap attached.

Housing subassembly 8 as shown disassembled in FIG. 8 comprises an applicator roller 90 with axle pins 91 and a cover 81 with a shape which generally conforms to the shape of mechanism assembly 5. Right side 82 of cover 81 is completely open to receive mechanism subassembly 5, with semi-circular edges 84 and 83 of the front and rear sides of cover 81 aligning flush with semi-circular wall 56 of mechanism subassembly 5. Cover 81 additionally comprises:

an access window 85, approximately an inch long, in the middle of its top side;

a stamp ejection window 86 appropriately placed in upper left side of cover 81 to allow separator edge 60 of mechanism subassembly 5 to project out when device 1 is fully assembled;

a slot 87 appropriately placed in the lower left side of cover 81 to allow ratchet wheel 66 of mechanism subassembly 5 to project out when device 1 is fully assembled;

two brackets 88, each with a hole 89 to accept axle pins 91 of applicator roller 90, attached at the left end of the top side of cover 81;

rails 92 and 93, as shown in FIG. 19, appropriately attached to inside of cover 81 to allow the base 53 and the platen 59 of mechanism assembly 5 to slide on when the mechanism assembly 5 is inserted into the housing assembly 8.

Applicator roller 90 is assembled to cover 81 by inserting axle pins 91 into holes 89 while lightly pulling apart brackets 88 to temporarily expand the distance between two holes 89.

Device 1 is assembled by sliding mechanism assembly 5, with connector strap 7 attached, into housing subassembly 8.

Figure 9:
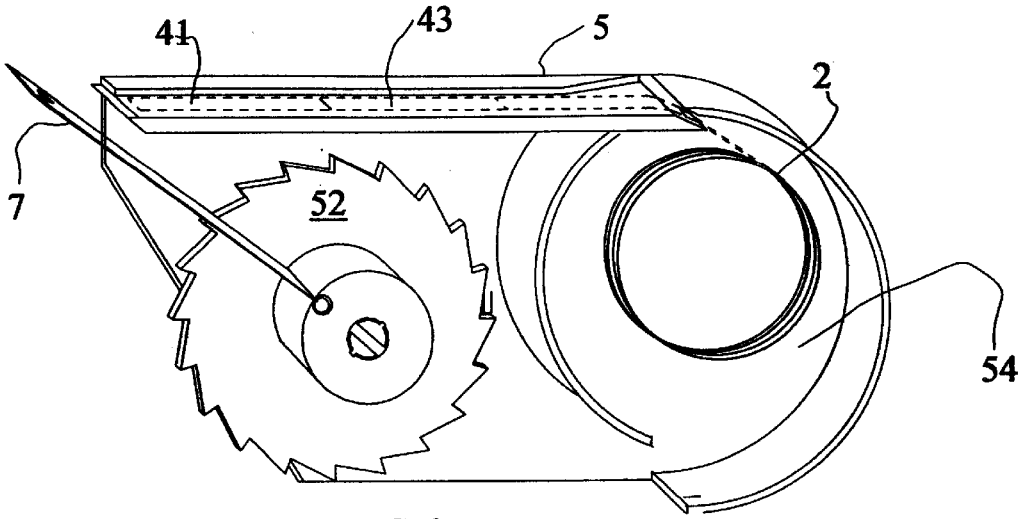
FIG. 9 shows the mechanism subassembly loaded with a new stamp roll.
Figure 10:
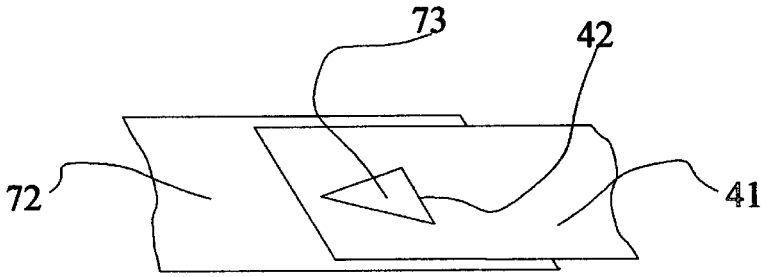
FIG. 10 shows details of attaching the connector strap to the free backing paper at the free end of the stamp roll.

Prior to using device 1 with a new stamp roll 2, if there is no free backing paper 4 at the free end of stamp roll 2, a stamp 3 is manually separated from backing paper 4 and the rest of stamp roll 2 and used immediately or saved for later use, thereby generating some free backing paper 41 at the free end of stamp roll 2. To use device 1, mechanism assembly 5, with connector strap 7 attached, is separated from housing assembly 8. The stamp roll 2 is dropped into stamp roll holding chamber 54. As shown in FIG. 9, the free end of stamp roll 2 is then passed through slot 14 over platen 59 to separator edge 60. As shown in FIG. 10, flat part 72 of connector strap 7 is extended over the separator edge 60 and connected to free backing paper 41 at the free end of stamp roll 2 using the pointed hook 73 and a slit 42 made into free backing paper 41. Ratchet wheel 66 is then rotated to spool flat part 72 of connector strap 7 over reel 67, thereby pulling plain backing paper 41 at the free end of stamp roll 2 over separator edge 60. Ratchet wheel 66 is rotated just enough to align the leading edge of first stamp 43 of the free end of stamp roll 2 with separator edge 60. The device 1 is reassembled by sliding the thus prepared mechanism assembly 5 into housing assembly 8.

Figure 11:
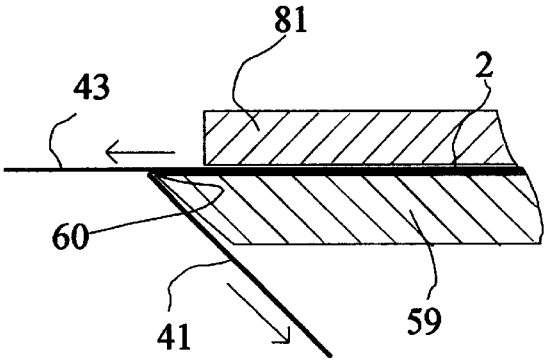
FIG. 11 shows an enlarged cross-sectional view of the part of device in which the backing paper separates from the stamp.
Figure 12:
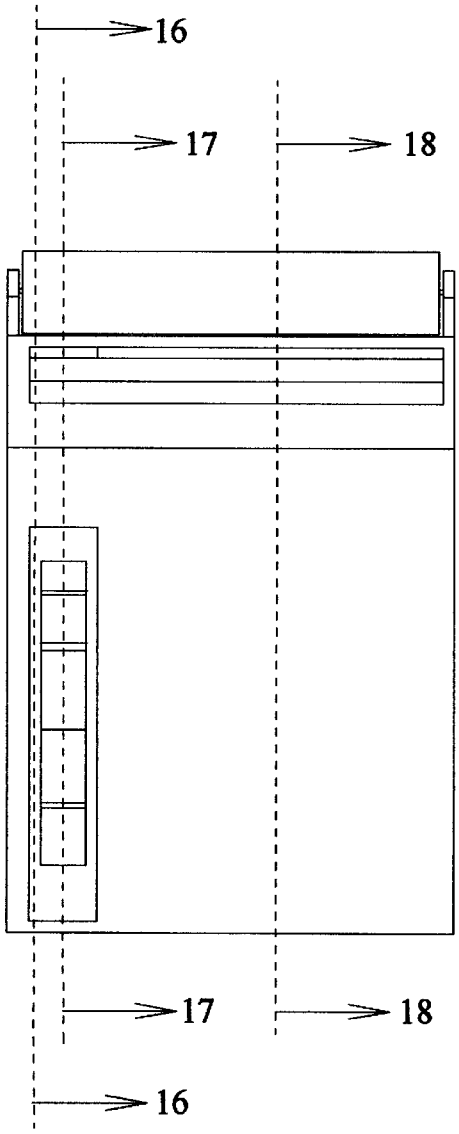
FIG. 12 shows a left elevation view of the device shown in FIG. 1.
Figure 13:
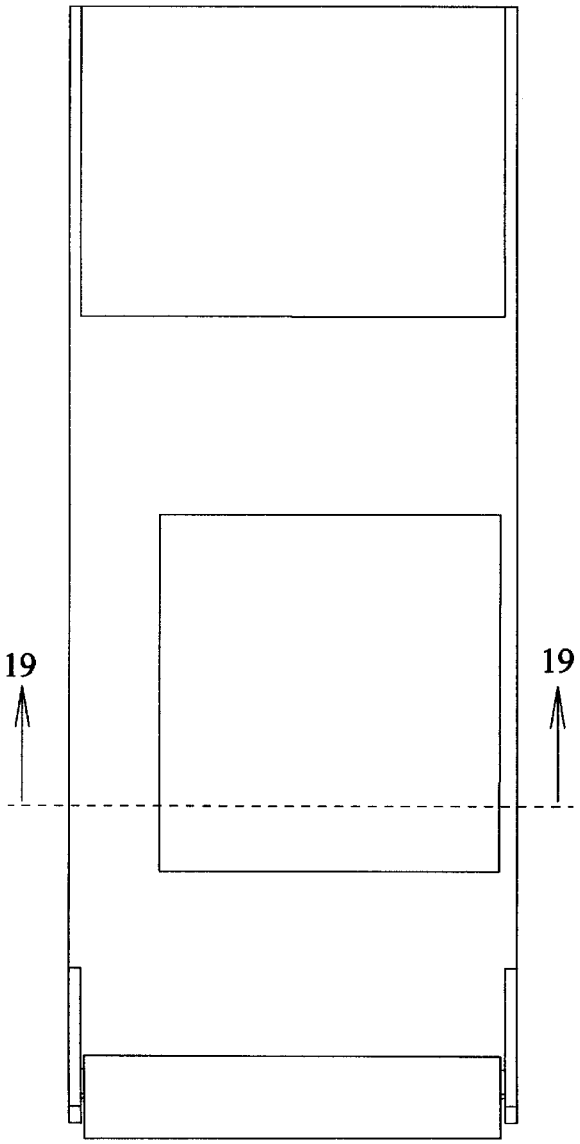
FIG. 13 is a top view of the device shown in FIG. 1.
Figure 14:
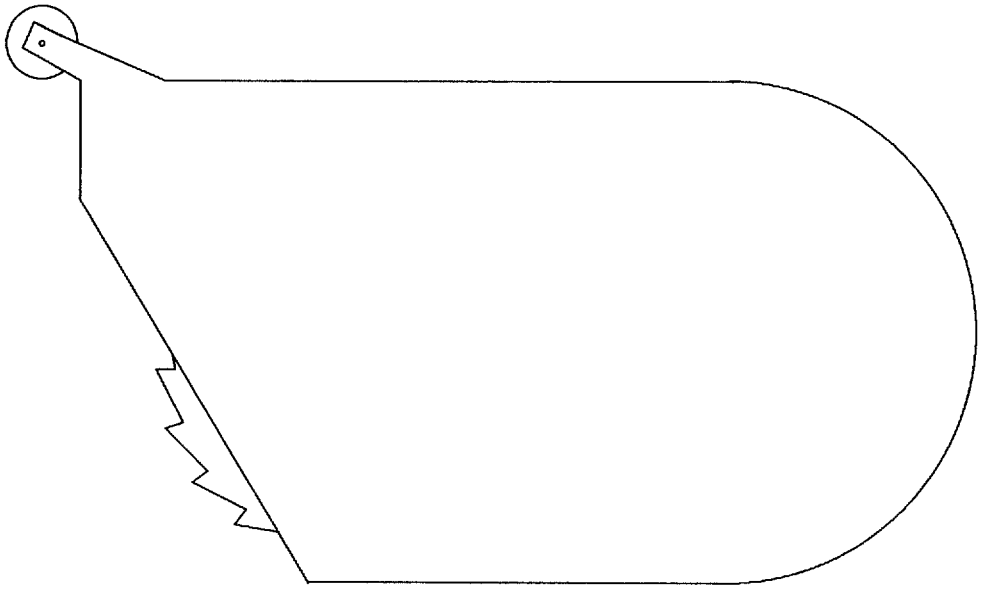
FIG. 14 is a front elevation view of the device shown in FIG. 1.
Figure 15:
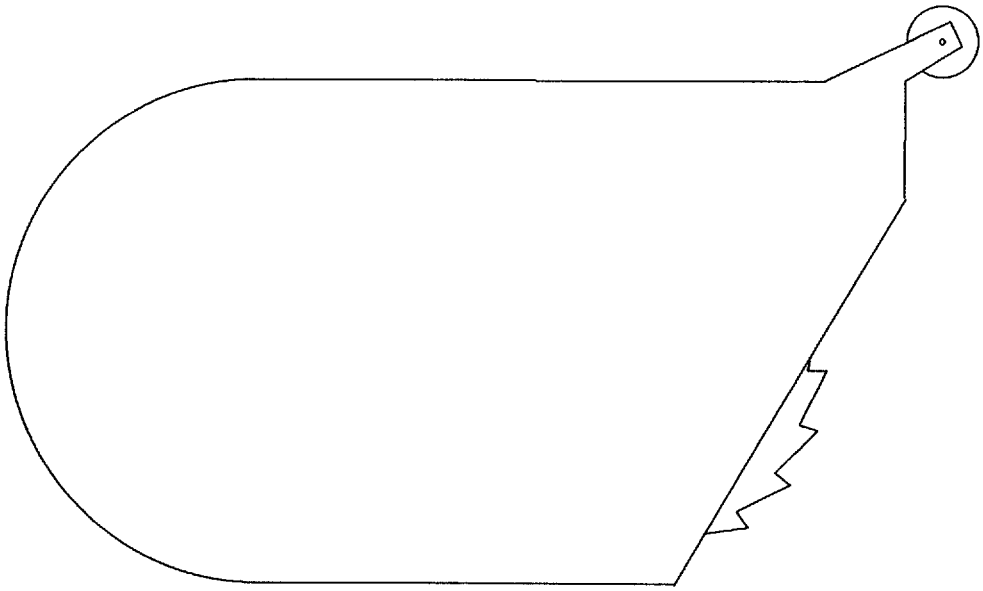
FIG. 15 is a rear elevation view of the device shown in FIG. 1.
Figure 16:
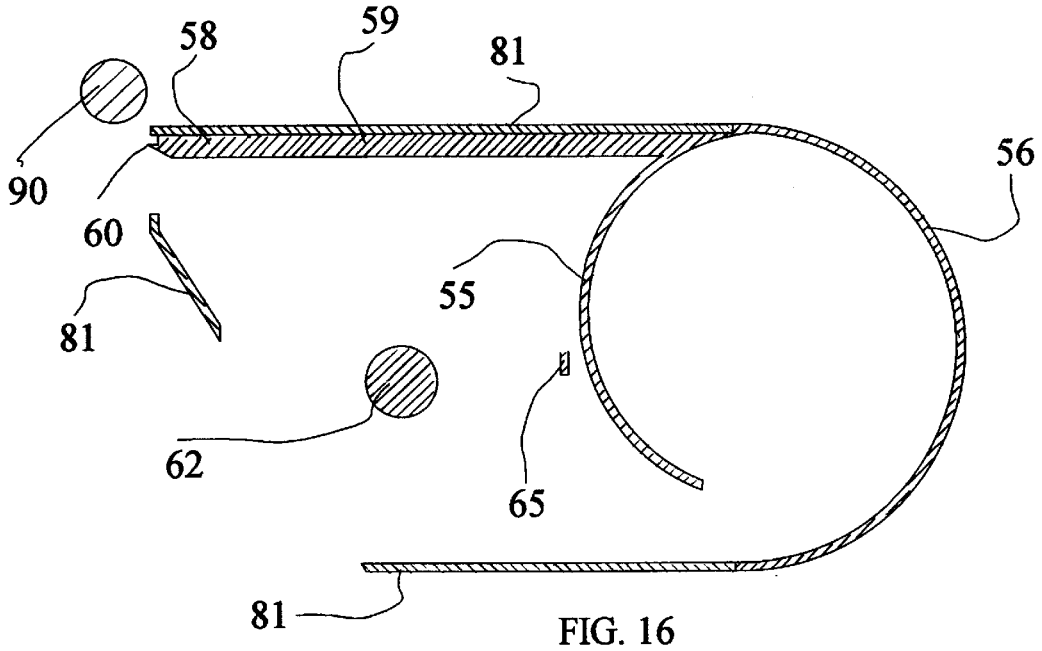
FIG. 16 is a cross-sectional view taken along section lines line 16—16 in FIG. 12 shown in FIG. 1 without the connector strap attached.
Figure 17:
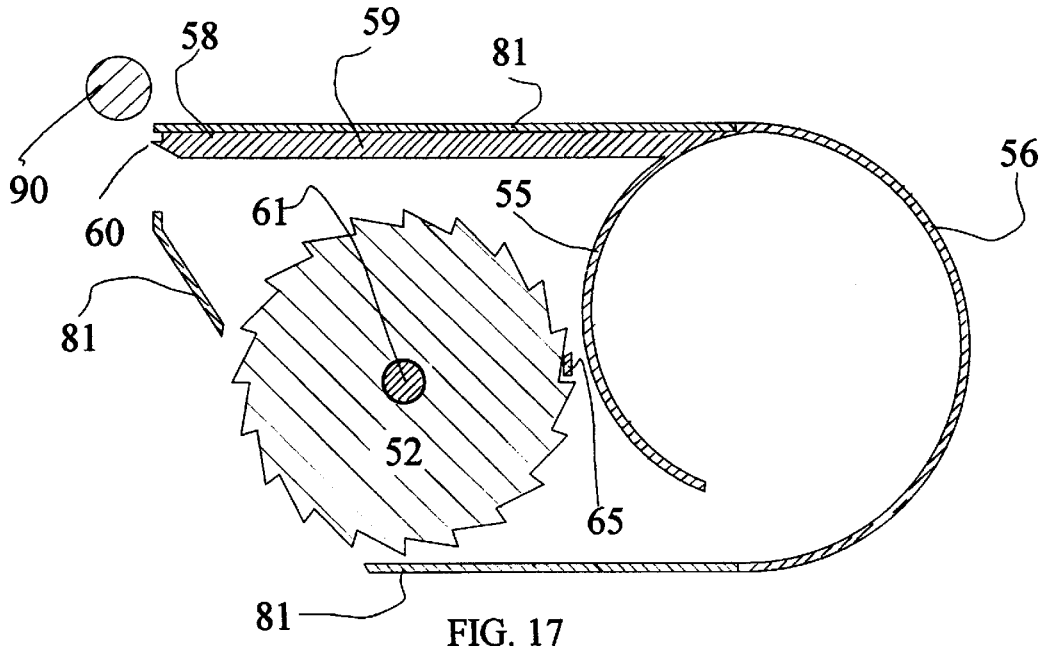
FIG. 17 is a cross-sectional view taken along section lines line 17—17 in FIG. 12 without the connector strap attached.
Figure 18:
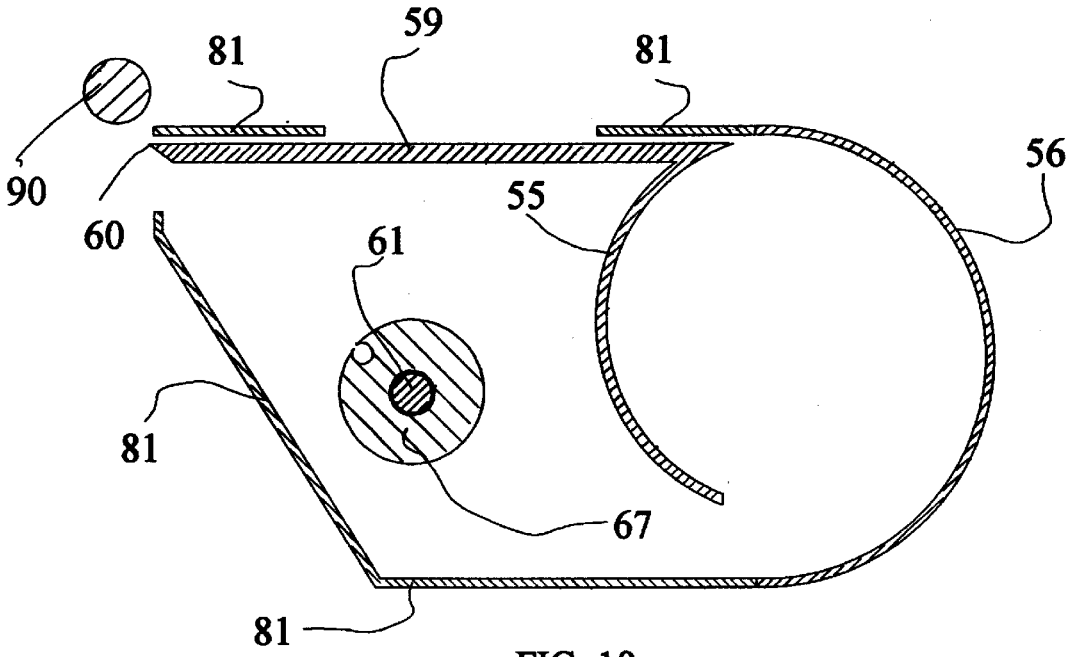
FIG. 18 is a cross-sectional view taken along section lines line 18—18 in FIG. 12 without the connector strap attached.

Once device 1 is assembled and loaded with the stamp roll 2 as described in the previous paragraph and when it is necessary to deploy stamp 43 , ratchet wheel 22 is rotated. Ratchet wheel 66 may be rotated either by a finger or by moving device 1 on top of the mail to the right under light pressure, causing ratchet wheel 66 to rotate. The rotating ratchet wheel 66 causes reel 67 to retract free backing paper 41 over the separator edge 60 to be spooled on reel 67 inside device 1. As shown in FIG. 11, retracting free backing paper 41 undergoes an abrupt change in direction at separator edge 60, thereby causing stamp 43 to be separated from backing paper 4. Ratchet wheel 66 is rotated just enough to nearly expose whole stamp 43 outside stamp ejection window 86. Device 1 is appropriately moved to bring the sticky surface of stamp 43 in contact with the mail at the desired location. Finally, the applicator roller 38 is rolled over stamp 43 while applying pressure with a finger to the part of stamp roll 2 exposed through the access window 85, thereby causing stamp 43 to be permanently deployed on the mail and separated from device 1. The process is repeated every time a stamp needs to be deployed, until the stamp roll 2 is completely used up. When stamp roll 2 is completely used up, mechanism assembly 5 is separated from housing assembly 8, the used up backing paper 4 is detached from the connector strap 7 and discarded, mechanism assembly 5 is prepared with a new stamp roll 2, and device 1 is reassembled.

The device 1 can also be used as a conventional dispenser with postage stamp rolls with the pre-glued backside. A postage stamp roll with pre-glued backside is dropped into stamp roll holding chamber 54. The free end of the stamp roll is then passed through slot 14 over platen 59 to separator edge 60. The device 1 is reassembled by sliding the thus prepared mechanism assembly 5 into housing assembly 8. Once device 1 is assembled and loaded with the stamp roll and when it is necessary to dispense a stamp, the stamp at the free end is advanced through the stamp ejection window 86 by using a finger to push the part of the stamp roll seen through the access window 85 of the housing assembly 8. The stamp advanced through the stamp ejection window 86 is separated at perforations while using a finger to apply pressure to the part of the stamp roll seen through the access window 85.

I claim:

1. A dispenser of stamps from self adhesive postage stamp rolls with a means to hold a self adhesive postage stamp roll, a means to separate from the backing paper and dispense the stamps from the stamp roll in sequence, a means to spool the backing paper from the dispensed stamps inside the dispenser for disposal after all the stamps in the roll are dispensed, and thereby, a means to eliminate need for manual separation of stamps from the backing paper and tearing and discard of backing paper after deploying each stamp, the said dispenser comprising:

a housing assembly having one side completely open for insertion and removal of mechanism assembly, the opposite side with one opening for dispensing of a stamp and another opening for access to a ratchet wheel of the mechanism assembly;

a mechanism assembly having a stamp roll holding chamber, a stamp conveyer platen for conveyance of stamps, a separator edge for separation of stamps from the backing paper and a ratchet wheel with a directly attached spooler for spooling the backing paper separated from the dispensed stamps;

a connector strap for conveniently attaching the free end of the backing paper to the spooler.

2. The dispenser in claim 1 wherein said housing assembly has an applicator roller for applying pressure to deploy a stamp just separated from the backing paper, and an access window in the top side of the housing assembly to prevent the stamps from moving when the applicator roller is used for deploying the stamp and thereby by causing the just deployed stamp to separate from the rest of the stamp roll.

* * * * *